United States Patent [19]

Olivier-Martin

[11] 4,098,460

[45] Jul. 4, 1978

[54] CONCRETE UNIT PRESTRESSED USING TENDONS STRESSED BEFORE CONCRETING, MORE PARTICULARLY A RAILWAY SLEEPER

[75] Inventor: Jean Olivier-Martin, Vaucresson, France

[73] Assignee: Societe Technique pour l'Utilisation de la Precontrainte, France

[21] Appl. No.: 703,960

[22] Filed: Jul. 9, 1976

[30] Foreign Application Priority Data

Jul. 17, 1975 [FR] France ..... 75 22403

[51] Int. Cl.[2] ..... E01B 3/34

[52] U.S. Cl. ..... 238/91; 52/223 R; 238/85

[58] Field of Search ..... 238/85, 86, 90, 91, 238/92, 94; 52/223 R

[56] References Cited

U.S. PATENT DOCUMENTS

| | | | |
|---|---|---|---|
| 3,062,450 | 11/1962 | Hanff | 238/85 |
| 3,948,010 | 4/1976 | Sonneville | 238/85 |
| 3,994,436 | 11/1976 | Sonneville | 238/90 |

FOREIGN PATENT DOCUMENTS

| | | | |
|---|---|---|---|
| 234,364 | 12/1959 | Australia | 52/223 R |
| 1,047,105 | 12/1953 | France | 238/85 |
| 1,165,231 | 3/1964 | Fed. Rep. of Germany | 52/223 R |
| 585,995 | 11/1958 | Italy | 52/223 R |
| 107,106 | 4/1943 | Sweden | 52/223 R |

OTHER PUBLICATIONS

American Steel & Wire, Div. of U.S. Steel Co., Cleveland Ohio, Sales Brochure dated 30 Mar. 1954, pp. 4 & 5.

*Primary Examiner*—Drayton E. Hoffman
*Assistant Examiner*—Carl Rowold
*Attorney, Agent, or Firm*—Jacobs & Jacobs

[57] ABSTRACT

A long concrete unit, prestressed by tendons tensioned before concreting, at least one section of which, near the end of the said unit, is submitted to maximum loads, characterized by the fact that at least one improved-bond prestressing tendon is surrounded by spirals located on either side of the zone of maximum tensile stress.

3 Claims, 3 Drawing Figures

CONCRETE UNIT PRESTRESSED USING TENDONS STRESSED BEFORE CONCRETING, MORE PARTICULARLY A RAILWAY SLEEPER

The present invention concerns an improvement to concrete units prestressed by tendons stressed before concreting.

It is known that for prestressed concrete units of this type, such as beams, railway sleepers, poles, etc. manufactured in factories, the prestress reaches its full value only at a certain distance from the extremity of the unit. This distance depends on a combination of several factors, such as bond quality of tendons, concrete strength, method of releasing the tendons after hardening of the concrete. That portion of the unit near its extremities constitutes therefore a zone of lesser strength than the rest of the unit. This weaker zone becomes a major drawback when the units are short, especially when the supported load effects — bending moment and shear force — are large in this end section. This is so in the case of railway sleepers.

A railway sleeper can be considered as a beam bearing on elastic ground and loaded at two points near the extremities, which are the bearing points of the two rails. It is under the rail that bending moments and shear forces, increased by dynamic effects, are the largest.

When submitted to the bending moment, the portion of the sleeper situated under the rail tends to crack. The tensile stresses tend to make the tendon slip in the concrete mass, which favors the opening of cracks and leads to the failure of the sleeper. The phenomenon is aggravated by the presence of the shear force, which is a maximum at that section.

An improvement of strength in that section has consisted, up until now, in using improved bond tendons and in increasing the total length of the sleeper in order to position this most loaded cross section further away from the end. This increase in length of sleeper has the disadvantage of making it heavier and more expensive.

The purpose of the present invention is to improve the strength of this section near the end by combining the already known use of improved bond tendons with a particular method of reinforcing the concrete around these tendons.

This reinforcing consists in surrounding the prestressing tendons at both sides of the most heavily loaded zone, with spirally wound steel wire extending, on one hand, from one edge of this zone up to the end of the sleeper and, on the other hand, from the other end of this zone towards the midsection of the sleeper. The purpose of these spirals is to resist the expansion of the concrete around the tendons and thus provide a better bond to the latter and prevent their slipping. Thus, the crack opening in the most heavily loaded intermediate section is limited and the failure of the unit is retarded.

In the case where the presence of the spiral in the immediate vicinity of the rail does not hinder the placing of the rail fixings, the two spirals can then be replaced by one continuous spiral.

It is commonly known that the distance from the end of the unit before the full prestress is reached increases with the tendon diameter. The reinforcement in accordance with the invention permits a reduction of this length and the use of larger diameter tendons, thus reducing the number of the latter. The result is a saving of materials and labor and concreting is simplified. To be quite clear, prestressing of a sleeper can be carried out using four tendons only consisting of 10 mm diameter indented wire or using four equivalent strands, the spiral reinforcement consisting of 4 mm wire.

Finally, the strength of the most heavily loaded section can be improved by introducing a "passive" (i.e., not stressed) reinforcement, in the bottom of the sleeper under the rail position which can consist of several steel bars in the shape of stirrups.

The attached drawings illustrate, by way of example only, an embodiment of a railway sleeper in accordance with the invention:

Figure 1:
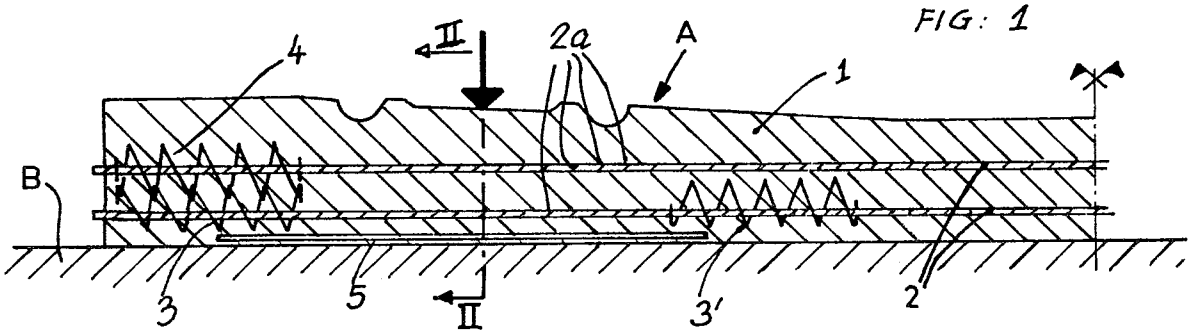
FIG. 1 shows a half-elevation of a sleeper.

The concrete 1 of sleeper A is prestressed by tendons 2 stressed before concreting. Tendons 2 are provided with distributed indentations 2*a*. The sleeper bearing on an elastic ground B, the most heavily loaded zone stretches to either side of cross-section II—II, corresponding to a rail center line. The spirals 3 and 3' are wound around the bottom tendons 2 and are positioned symetrically at either side of II—II. It is clear that these lower tendons become most elongated when the sleeper is subjected to the bending moment under the rail load.

The top tendons 2 are surrounded by spirals 4 close to their extremities only in order to reduce the prestressing transfer length at the end of the sleeper. At the center of the sleeper the spirals around these latter tendons may be omitted since the risk of cracking is much less at this level than in the case of the lower tendons; in other words the elongation of the tendons and the increase in tensile stress in the concrete are much smaller in this zone.

The spiral bindings 3 and 4 at the extremity of sleeper A are so disposed as to permit interpenetration of their spires one inside the other, preferably by screwing, as these spires are of the same pitch. This arrangement gives these spirals a better resistance to the transverse tensile stresses which occur near extremity of the sleeper as a result of the transmission to the concrete of the tensile force in the tendon.

Figure 3:
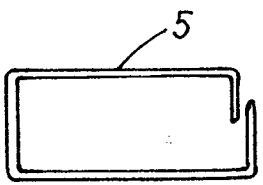
FIG. 3 is a plan view of a "passive" reinforcement stirrup.
Figure 2:
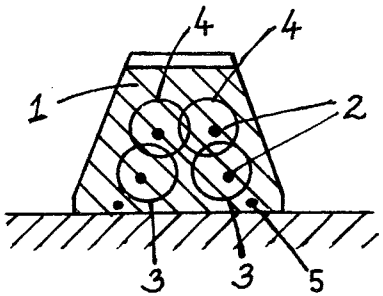
FIG. 2 shows a cross-section II—II of FIG. 1.

The sleeper can be provided with complementary "passive" reinforcements in the form of one or two stirrups such as those shown in FIG. 3. These stirrups are made of a length of wire bent in rectangular shape, the ends of which overlap in a direction perpendicular to that of the main tendons.

The invention concerns concrete products prestressed by bond between the prestressing steel and the concrete and more particularly railway sleepers.

What I claim is:

1. In a prestressed concrete railway sleeper, comprising an elongated concrete body, straight parallel steel tendons coextensive with and distributed and embedded in the lower portion of said body, said tendons being in a pretensioned state and having therealong distributed surface unevenness, the improvement which comprises at least one helical wire winding of limited length surrounding each of said tendons, said winding being symmetrically arranged with respect to the location of the medial plane of each rail on the sleeper, said helical wires being of the same pitch and two by two mutually interpenetrated by screwing.

2. A sleeper according to claim 1, wherein at least part of the tendons is solid steel wire provided with indentations.

3. A sleeper according to claim 1, wherein at least part of the tendons is indented strands of wire.

* * * * *